US008631515B2

(12) United States Patent
Van Sisseren et al.

(10) Patent No.: US 8,631,515 B2
(45) Date of Patent: Jan. 21, 2014

(54) BIKINI TOP WITH FRICTION LOCKING CORD ADJUSTMENT SYSTEM

(75) Inventors: Sheilah A. Van Sisseren, Portland, OR (US); Andrea J. Staub, Portland, OR (US); Tory M. Cross, Portland, OR (US)

(73) Assignee: Nike, Inc., Beaverton, OR (US)

( * ) Notice: Subject to any disclaimer, the term of this patent is extended or adjusted under 35 U.S.C. 154(b) by 448 days.

(21) Appl. No.: 12/911,902

(22) Filed: Oct. 26, 2010

(65) Prior Publication Data

US 2012/0096617 A1 Apr. 26, 2012

(51) Int. Cl.
*A41D 7/00* (2006.01)

(52) U.S. Cl.
USPC ..... 2/67; 450/86

(58) Field of Classification Search
USPC ..... 2/67, 69, 335; 450/86, 88, 89, 69; 289/1.2
See application file for complete search history.

(56) References Cited

U.S. PATENT DOCUMENTS

| | | | | | |
|---|---|---|---|---|---|
| 2,042,924 | A | * | 6/1936 | Cunningham | 2/67 |
| 2,075,387 | A | * | 3/1937 | Daniel | 2/67 |
| 2,428,175 | A | * | 9/1947 | Norton | 450/32 |
| 2,455,036 | A | * | 11/1948 | Boylan | 450/86 |
| 2,484,467 | A | * | 10/1949 | Schacht | 450/69 |
| 2,488,280 | A | * | 11/1949 | Flood | 40/663 |
| 2,542,881 | A | * | 2/1951 | Ries | 450/59 |
| 3,164,154 | A | * | 1/1965 | Simonsen | 450/62 |
| 3,306,299 | A | * | 2/1967 | Paramore | 450/81 |
| 3,489,153 | A | * | 1/1970 | Gaisser | 450/88 |
| 3,939,845 | A | * | 2/1976 | Guidoni | 450/68 |
| 4,031,900 | A | * | 6/1977 | Guidoni | 450/69 |
| 4,106,266 | A | * | 8/1978 | Hibbert | 54/24 |
| D293,156 | S | * | 12/1987 | Dunnagan | D2/737 |
| 4,973,090 | A | * | 11/1990 | Hyduke | 289/1.2 |
| 5,299,323 | A | * | 4/1994 | Schaefer et al. | 2/93 |
| 5,822,800 | A | * | 10/1998 | Anderson | 2/202 |
| 6,056,626 | A | * | 5/2000 | Fildan | 450/86 |
| 6,059,634 | A | * | 5/2000 | Fildan | 450/86 |
| 6,110,007 | A | * | 8/2000 | Rittmann | 450/86 |
| 6,179,687 | B1 | * | 1/2001 | Lee et al. | 450/88 |
| 6,280,287 | B1 | * | 8/2001 | Keith et al. | 450/1 |

(Continued)

OTHER PUBLICATIONS

International Search Report and Written Opinion for PCT/US2011/057777 filed Oct. 26, 2011.

(Continued)

*Primary Examiner* — Richale Quinn
(74) *Attorney, Agent, or Firm* — Shook, Hardy & Bacon L.L.P.

(57) ABSTRACT

Swim tops having a friction locking cord adjustment system are described. The swim top may have a pair of friction locking adjustment terminal ends. Each friction locking adjustment terminal end may be secured to an end of one of a pair of neck cords of the swim top. The friction locking adjustment terminal ends may be slidably affixed to the opposing neck cord of the swim top to permit the fit of the top to be adjusted. The friction locking adjustment terminal ends may be comprised of adjustment buckles or slidable knots. Adjustment buckles may include two or more silicone coated pads having holes for threading the cords of the swim top. A friction enhancing pattern may be proximate to the holes of the adjustment buckles. The friction enhancing pattern may engage the cord passing through that hole when the swim top is worn to enhance the secure fit of the swim top.

7 Claims, 8 Drawing Sheets

(56) References Cited

U.S. PATENT DOCUMENTS

| | | | | |
|---|---|---|---|---|
| 6,386,944 | B2 * | 5/2002 | Keith et al. | 450/1 |
| 6,857,936 | B2 * | 2/2005 | Jones et al. | 450/86 |
| 7,056,187 | B2 * | 6/2006 | Cassity | 450/88 |
| 7,168,096 | B1 * | 1/2007 | Landa et al. | 2/67 |
| 7,547,241 | B2 * | 6/2009 | Sakabe et al. | 450/70 |
| 7,938,710 | B2 * | 5/2011 | Silverman et al. | 450/67 |
| 8,016,640 | B2 * | 9/2011 | Morgan | 450/62 |
| 2001/0012747 | A1 * | 8/2001 | Flaherty | 450/1 |
| 2001/0053655 | A1 * | 12/2001 | Keith et al. | 450/41 |
| 2007/0101554 | A1 * | 5/2007 | O'Brien | 24/129 R |
| 2010/0022165 | A1 * | 1/2010 | Silverman et al. | 450/65 |
| 2011/0081827 | A1 * | 4/2011 | Williams | 450/65 |
| 2011/0191944 | A1 * | 8/2011 | Lescom et al. | 2/335 |
| 2012/0094576 | A1 * | 4/2012 | Tedder | 450/92 |

OTHER PUBLICATIONS http:/www.athensbeadsandthings.com/Instructions/AdjustableKnots/adjustable-knots.html.

http:/www.ehow.com/how_4443609_tie-adjustable-knot-cord.html.

* cited by examiner

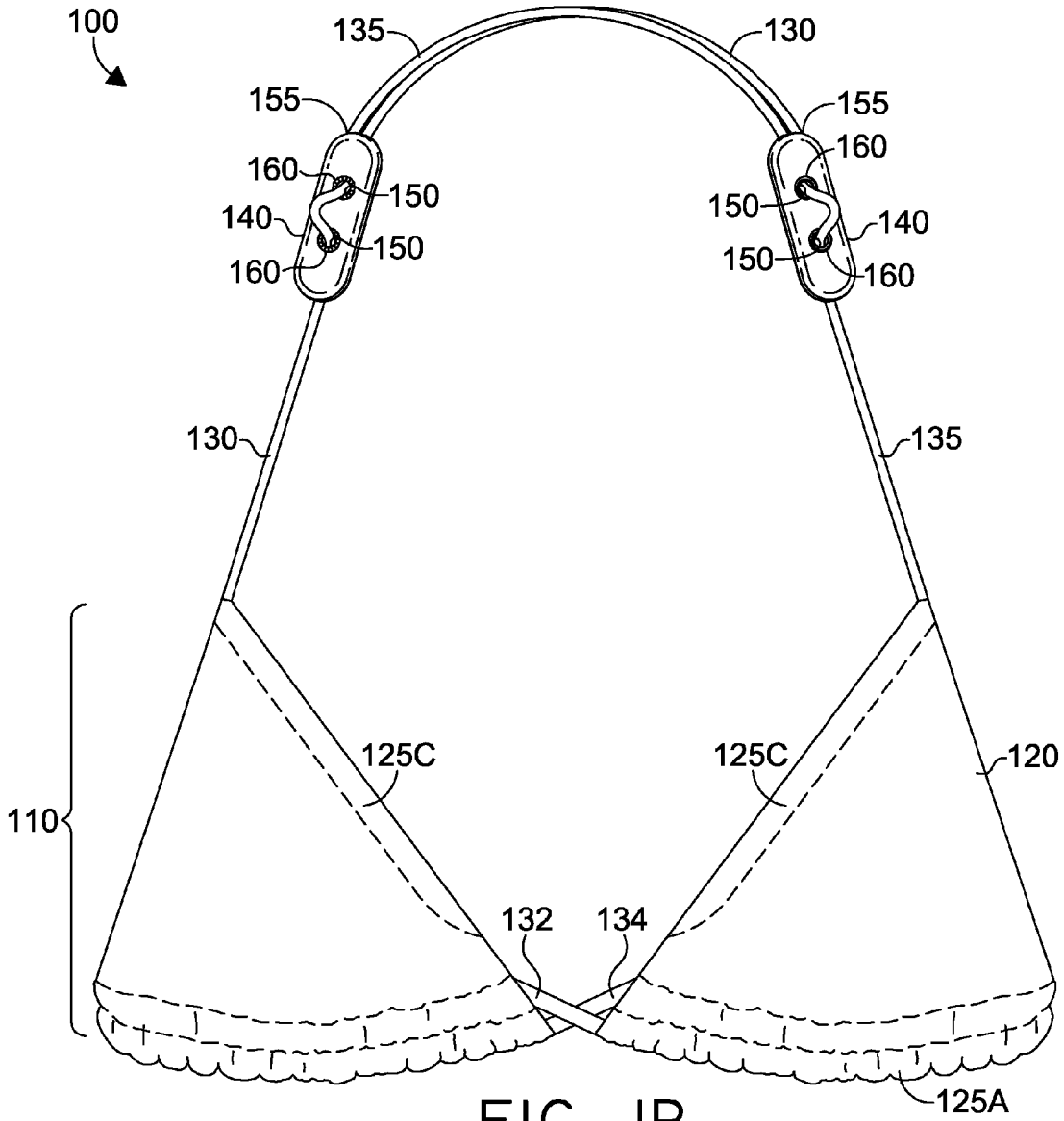
FIG. IB

BIKINI TOP WITH FRICTION LOCKING CORD ADJUSTMENT SYSTEM

SUMMARY

Embodiments of the invention are defined by the claims below, not this summary. A high-level overview of various aspects of the invention are provided here for that reason, to provide an overview of the disclosure, and to introduce a selection of concepts that are further described below in the detailed-description section below. This summary is not intended to identify key features or essential features of the claimed subject matter, nor is it intended to be used as an aid in isolation to determine the scope of the claimed subject matter.

Bikini tops are increasingly worn not only for swimming but in conjunction with other sporting activities like surfing, water-skiing, beach volleyball, water-polo, and jogging. These high impact sporting activities demand garments that support the breasts of a female athlete to prevent excessive motion during athletic activities. Classic bikini tops are typically configured with a halter design having ties around the back of the wearer's torso and neck. Women often fasten the closures of conventional bikini tops so that the bikini top is extremely close fitting in order to provide additional support during athletic activities. In addition to discomfort for the wearer, this can put more stress on the garment than it is usually required to withhold and lead to the straps cutting into the wearer, slipping or even breaking. Water based sporting activities also typically result in the bikini straps gradually loosening and slipping out of place potentially causing the female athlete annoyance and even embarrassment. In time sensitive sporting activities, the need to pause to readjust a bikini top may be costly to an athlete. As such, there is a need for a bikini top that provides the wearer better security and comfort when performing sporting activities.

The present invention provides a swim top having a friction locking cord adjustment system. In accordance with the present invention, the swim top may have a pair of friction locking adjustment terminal ends, each secured to an end of one of a pair of neck cords of the swim top. The friction locking adjustment terminal ends may be slidably affixed to the other neck cord of the swim top. The friction locking adjustment terminal ends may be comprised of adjustment buckles or slidable knots. The adjustment buckles may be comprised of two or more silicone coated pads having holes through which the cords of the swim top are threaded. A friction enhancing pattern may be proximate to the holes of the adjustment buckles. The friction enhancing pattern may engage the cord passing through that hole when the bikini top is worn to enhance the secure fit of the bikini top.

BRIEF DESCRIPTION OF THE SEVERAL VIEWS OF THE DRAWINGS

Examples of the present invention are described in detail below with reference to the attached drawing figures, which are incorporated by reference herein and wherein:

FIG. 1A-1C depict front views of a variety of exemplary swim tops in accordance with the present invention;

DETAILED DESCRIPTION

Figure 1A:
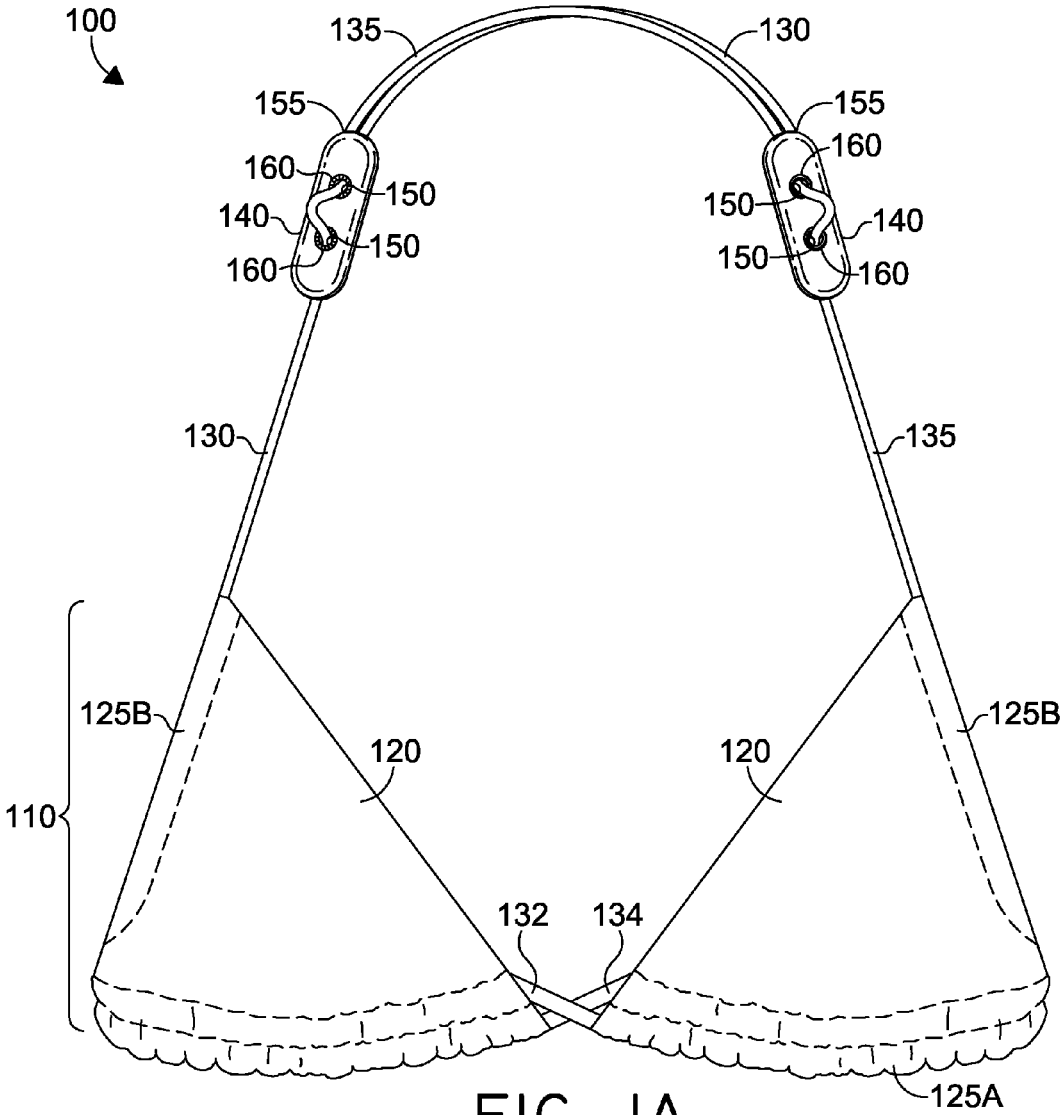

The subject matter of the present invention is described with specificity herein to meet statutory requirements. However, the description itself is not intended to necessarily limit the scope of claims. Rather, the claimed subject matter might be embodied in other ways to include different steps or combinations of steps similar to the ones described in this document, in conjunction with other present or future technologies. Although the terms "step" and/or "block" or "module" etc. might be used herein to connote different components of methods or systems employed, the terms should not be interpreted as implying any particular order among or between various steps herein disclosed unless and except when the order of individual steps is explicitly described.

The present invention relates to a swim top having a friction locking cord adjustment system. The swim top may have a pair of friction locking adjustment terminal ends, each secured to the end of a neck cord of the swim top. Friction locking adjustment terminal ends may be comprised of either slidable knots or adjustment buckles. The adjustment buckles may be comprised of two or more silicone coated pads having holes through which the cords of the swim top are threaded. A friction enhancing pattern may be proximate to the holes of the adjustment buckles. The friction enhancing pattern may engage the cord passing through that hole when the bikini top is worn to enhance the secure fit of the bikini top.

Accordingly, in one aspect, the present invention provides a friction locking cord adjustment system for a women's swim top. The friction locking cord adjustment system may prevent slippage of the swim top when the swim top is worn. The friction locking cord adjustment system may include a pair of cords and a pair of friction locking adjustment terminal ends. Each of the pair of friction locking adjustment terminal ends may be securely affixed to an end of one of the pair of cords and slidably affixed to the other of the pair of cords. The friction locking adjustment terminal ends may be comprised of slidable knots secured using the pair of cords. The friction locking adjustment ends may also be comprised of a pair of adjustment buckles. The friction locking cord adjustment system of the swim top may further include an opening in each of the pair of adjustment buckles such that a cord of the swim top may be threaded through the opening of each of the pair of adjustment buckles. A pair of openings in each of the pair of adjustment buckles may permit a cord to be slidably threaded through the openings in each of the pair of adjustment buckles such that the buckle may be comfortably flat against the skin of the wearer. The friction locking cord adjustment system of the swim top may also include a friction enhancing pattern proximate to at least one opening in each of the pair of adjustment buckles. A friction enhancing pattern may comprise, for example, a silicone pattern printed on the adjustment buckle. The threaded cord of the swim top may attach to a breast cup region of the swim top that covers the wearer's breasts when the swim top is worn. When the swim top is worn, the pair of cords therefore extend, in conjunction, behind the wearer's neck from one breast cup region to the other breast cup region.

In another aspect, the present invention provides a bikini top. The bikini top may include two panels configured to at least partially cover a wearer's breast when the bikini top is worn. The two panels may include hems along their edges. The bikini top may also include a pair of cords connecting the two panels by extending through the hems of the panels. The pair of cords may secure the two panels to the torso of a wearer when the bikini top is worn. The bikini top may also include a pair of adjustment buckles. Each of the pair of adjustment buckles may be securely affixed to an end of one of the pair of cords and may be slidably affixed to the other of the pair of cords. Each of the pair of adjustment buckles may be situated above one of the two panels of the bikini top. The bikini top may further include a pair of holes in each of the pair of adjustment buckles. Each adjustment buckle may contain two holes such that the cords are threaded through the holes of each adjustment buckle. The bikini top may also include a friction enhancing pattern near each hole in each of the pair of adjustment buckles. The friction enhancing pattern near each hole may engage the cord passing through that hole when the bikini top is worn to enhance the secure fit of the bikini top.

In yet another aspect, the present invention provides a bikini top. The bikini top may include two panels configured to at least partially cover a wearer's breast when the bikini top is worn. The two panels may include gathered hems along their bottom edges. The bikini top may also include a first pair of cords connecting the two panels by extending through the gathered hems of the panels. The first pair of cords may secure the two panels to the torso of a wearer when the bikini top is worn. The bikini top may also include a second pair of cords. Each of the second pair of cords may attach to the top of one of the two panels. Each of the second pair of cords may also extend behind a neck of the wearer when the bikini top is worn. The bikini top may also include a pair of friction locking adjustment terminal ends. Each of the pair of friction locking adjustment terminal ends may be securely affixed to an end of one of the second pair of cords and may be slidably affixed to the other of the second pair of cords. Each of the pair of friction locking adjustment terminal ends may include a slidable first knot secured utilizing the second pair of cords.

Swim tops in accordance with the present invention may have a friction locking cord adjustment system. Having briefly described an overview of embodiments of the present invention, an exemplary swim top having a friction locking cord adjustment system is described below.

Referring to the drawings in general and FIGS. 1-7 in particular, an exemplary swim top having a friction locking cord adjustment system is depicted in various views. While embodiments discussed herein refer to swim tops, it will be understood that embodiments are not limited to any particular style or type of garment used to support breast tissue during any type of athletic activity. The use of a friction locking cord adjustment system that prevents slippage of the straps of a garment may also be useful outside of the context of athletic sportswear. For example, other embodiments may include brassieres, camisoles, and leotards. Further, the depictions in the drawings are for exemplary purposes only and are in no way meant to limit the scope of the present invention to any style of swim top.

Figure 1C:
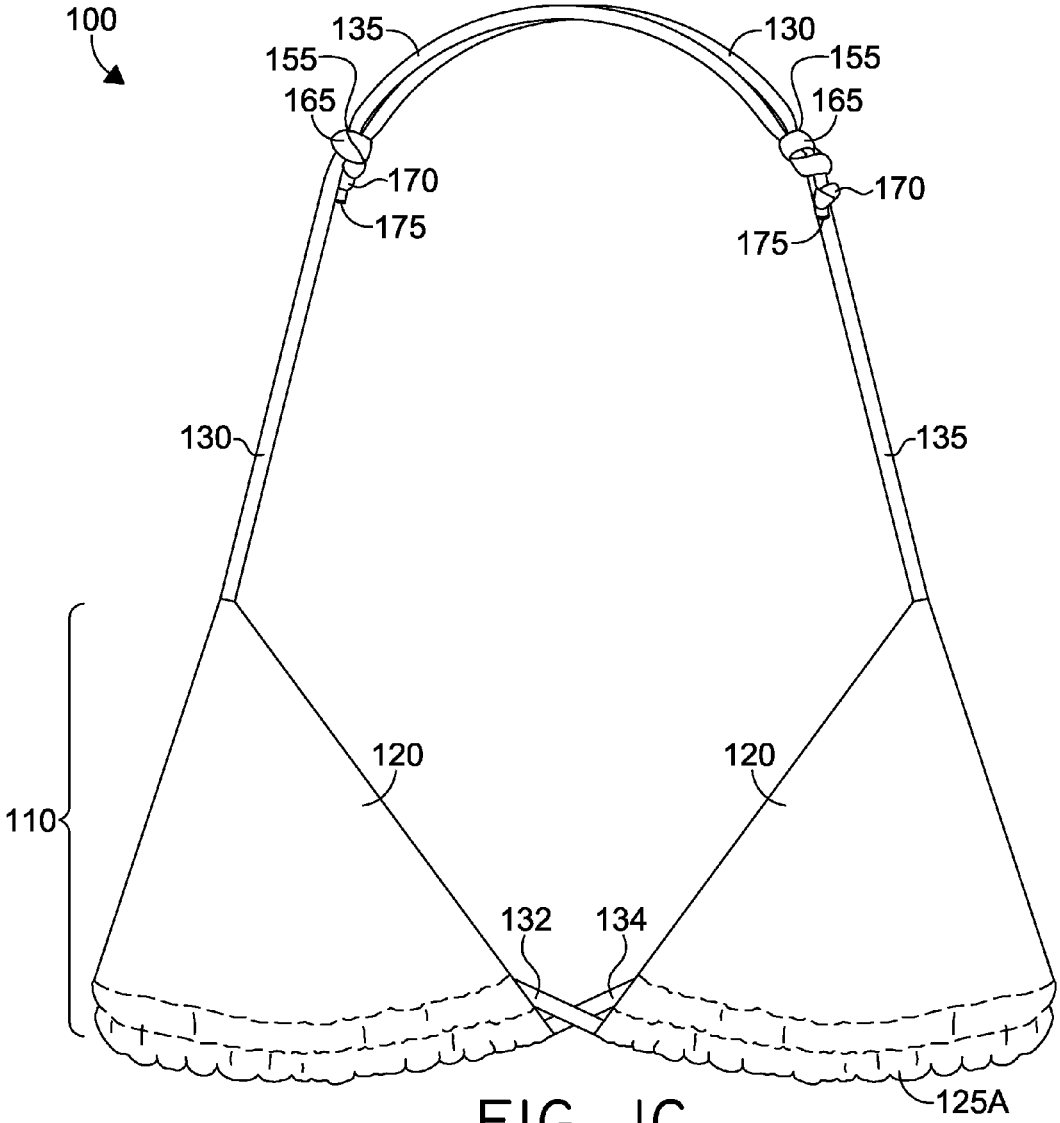

Referring now to FIGS. 1A-1C, a front view of a swim top illustrating features of the present invention is shown and designated generally as reference numeral 100. Turning to FIGS. 1A and 1B, swim top 100 may comprise a breast cup region 110, breast cup panels 120, tie cords 130 and 135, and adjustment buckles 140. The breast cup region 110 of the swim top is the portion of the swim top designed to encapsulate each of the wearer's breasts. Breast cup region 110 may include two breast cup panels 120 that may cover a portion of the torso of the wearer including the breast tissue. As illustrated in FIGS. 1A-1C, the breast cup panels 120 may be triangular in shape. However, other shapes commonly used in constructing bikini tops may also be used. By way of example, the panels may be oval, substantially U-shaped, round or rectangular. Panels 120 may contain hems 125 along their edges. Hems 125 may be stitched in such a manner that they define a continuous hollow cylindrical opening along the edges of panels 120. Hems 125 may also be stitched in such a manner that the hems 125A along the bottom edges of panels 120 are gathered or ruched. Gathered hems 125A along the bottom edges of swim top 100 may increase the fashionable appeal of top 100. Gathered hems 125A may also facilitate swim top 100 fitting a wearer more securely by increasing the ability of panels 120 to conform to the contours of a wearer's breasts. Hems 125B may be located on the top outer edges of panels 120 as shown in FIG. 1A. Hems 125C may be located on the top inner edges of panels 120 as shown in FIG. 1B. As illustrated in FIG. 1C, panels 120 may only include hems along the bottom edges 125A of panels 120. While FIGS. 1A-1C illustrate different combinations for the placement of hems 125 along the panels 120 of swim top 100, the drawing are not intended to be restrictive and other arrangements of hems 125 are possible, whether with adjustment buckles 140 or slidable knots 165.

With continued reference to FIG. 1A-1B, swim top 100 may also include two or more cords or ties 130 and 135, each of which may be inserted and threaded through the hems 125 of panels 120. Cords 130 and 135 may be used to secure the swim top to the neck of the wearer in conjunction with adjustment buckles 140. As illustrated in FIG. 1C cords 130 and 135 may also be used to secure the swim top to the neck of the wearer in conjunction with slidable knots 165. When the swim top is worn, cords 130 and 135 may extend, in conjunction, behind the wearer's neck from one breast cup panel 120 to the other breast cup panel 120. Swim top 100 may also include two or more cords or ties 132 and 134, each of which may be inserted and threaded through the hems 125A of panels 120 such that cords 132 and 134 secure the two panels 120 to a torso of a wearer when the bikini top is worn. The pair of cords 132 and 134 may provide better security to the wearer during sporting activities.

With continued reference to FIG. 1A-1B, swim top 100 may comprise two adjustment buckles 140 with each adjustment buckle situated above one of the two breast cup panels 120. Adjustment buckles 140 may contain at least two holes 150 such that cords 130 and 135 may be looped through the holes 150 of the pair of adjustment buckles 140. Cords 130 and 135 may extend from the top of breast cup panels 120 upwards through the holes 150 of attachment buckles 140 and around the neck of the wearer. Each of the pair of adjustment buckles 140 may be securely affixed to an end of one of the pair of cords 130 and 135 at points 155 and slidably affixed to the other of the pair of cords 130 and 135.

Adjustment buckles 140 may be constructed from a friction enhancing or a non-slip material to prevent the straps of swim top 100 from slipping out of place when the swim top is worn during athletic activities. Adjustment buckles 140 may contain a friction enhancing pattern 160 near one or more of holes 150. The friction enhancing pattern 160 near each hole 150 engages the cord 130 and/or 135 passing through that hole such that the pattern 160 increases the friction between the adjustment buckle 140 and the cords 130 and/or 135. The increased friction resulting from the pattern 160 enhances the secure fit of the swim top by preventing the straps of swim top 100 from slipping out of place when the swim top is worn. By way of example, during activities such as surfing, the friction pattern enhanced bond between the non-slip material adjustment buckles 140 and the cords 130 and 135 may prevent the ties of the swim top from being displaced and may even prevent the swim top from being washed away by strong waves.

Referring now to FIG. 1C, swim top 100 may comprise two slidable knots 165, with each knot 165 affixed to an end of either cords 130 or 135 at points 155. Slidable knots 165 may be secured using both cords 130 and 135 such that each knot 165 may be moved along either cord 130 and 135 by pulling on the knot 165. A second pair of fixed knots 170 may be located at the end of slidable knots 165 to prevent the slidable knots 165 from loosening. Each fixed knot 170 may be formed using the terminal end of either cord 130 or 135. To prevent fraying of the cords 130 and 135 and consequent unraveling of knots 170 and 165, the ends of cords 130 and 135 may be fastened with stitches 175. While FIG. 1C illustrates stitches 175 for preventing fraying of cords 130 and 135, other means for preventing fraying may be used, for instance a fray blocking adhesive may be applied to the ends of cords 130 and 135.

Figure 2:
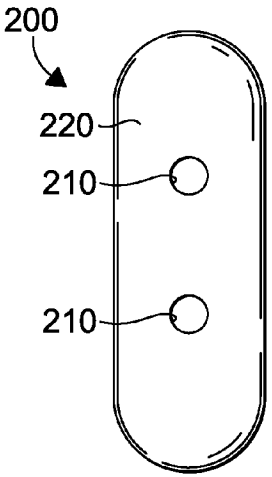
FIG. 2 depicts a rear view of an adjustment buckle embodying features of the present invention.

Turning now to FIG. 2, a rear view of an adjustment buckle illustrating features of the present invention is shown and designated generally as reference number 200. Adjustment buckle 200 may comprise openings 210 and an exterior surface 220. At least two openings 210 may be present in adjustment buckle 200. Openings 210 may be positioned on opposite sides of adjustment buckle 200 along a horizontal axis. Exterior surface 220 may be configured to contact a wearer's skin when the swim top is worn. As such, exterior surface 220 of adjustment buckle may comprise of a soft, flexible, non-abrasive material. By way of example, exterior surface 220 may comprise of suede-like material that provides a soft touch on the skin of the wearer.

Figure 3B:
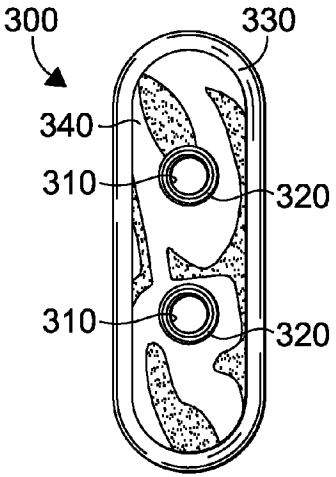
FIGS. 3A-3B depict a front view of an adjustment buckle embodying features of the present invention.
Figure 3A:
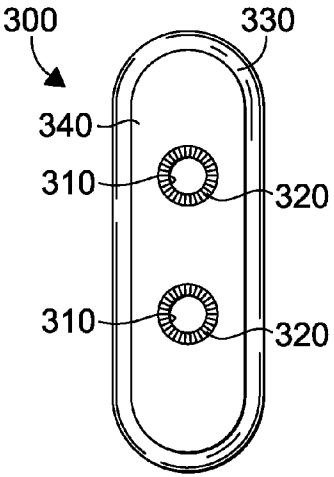

Turning now to FIG. 3A-3B, a front view of an adjustment buckle illustrating features of the present invention is shown and designated generally as reference number 300. Adjustment buckle 300 may comprise holes 310, friction enhancing pattern 320, an exterior surface 330 and a non-slip layer 340. The adjustment buckle 300 may be substantially oval shaped and may contain two or more holes 310. Holes 310 may be positioned on opposite sides of the adjustment buckle 300 such that the holes 310 are approximately equidistant from each other and an outer edge of adjustment buckle 300. Holes 310 may be sized to facilitate passing a cord of a swim top through the opening. Holes 310 of adjustment buckle 300 permit the cord of the swim top to be threaded through the adjustment buckle 300 such that the buckle lies comfortably flat against the skin of the wearer.

Holes 310 may be surrounded by friction enhancing pattern 320. Friction enhancing pattern 320 may comprise of a tacky, non-slip material placed around each hole 310. The tacky nature of friction enhancing pattern 320 may limit the ability of a cord threaded through hole 310 to move readily. As such, once a cord of a swim top is adjusted to a desired fit by the wearer, the grip of the non-slip material of friction enhancing pattern 320 on the cord helps to prevent the cord from slipping out of the desired position.

Although friction enhancing pattern 320 is depicted in FIG. 3A with lines radiating from hole 310 to form an eyelet-shaped pattern, other configurations may be used for a friction enhancing pattern 320 during construction of an adjustment buckle in accordance with the present invention. By way of example, friction enhancing pattern 320 may be formed from spirals emanating from hole 310, as depicted in FIG. 3B. In another example, friction enhancing pattern 320 may be formed from concentric circles emanating from hole 310. Friction enhancing pattern 320 may be constructed of a silicone material attached to exterior surface 330 around each hole 310 of the adjustment buckle 300. By way of example, friction enhancing pattern 320 may be constructed from a silicone material printed on the adjustment buckle 300. In another example, friction enhancing pattern 320 may be constructed from a puff ink material affixed to adjustment buckle 300.

Exterior surface 330 of adjustment buckle may comprise of a soft, flexible, non-abrasive material. Exterior surface 330 may be constructed from materials used in constructing swimwear. In addition to being soft and flexible, the materials used to construct exterior surface 330 may feature durable, dyeable, and water proof or water resistant properties. By way of example, exterior surface 330 may comprise a suede-like material that provides a soft touch on the skin of the wearer. A non-slip layer 340 may be attached to the exterior surface 330 of adjustment buckle 300. For example, non-slip layer 340 may be printed on exterior surface 330. Layer 340 may be constructed from a silicone material. As depicted in FIG. 3B, various designs or patterns may be printed on non-slip layer 340. Like friction enhancing pattern 320, the non-slip layer 340 may assist in keeping in place the cords of a swim top that are threaded through the adjustment buckle 300.

Figure 4A:
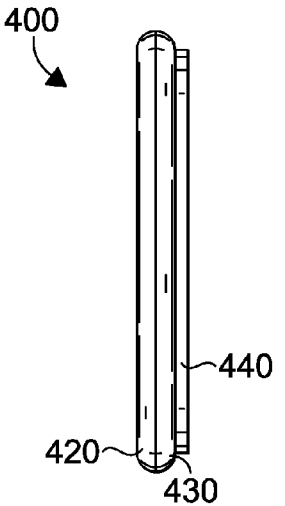
FIG. 4A depicts a side view of an adjustment buckle embodying features of the present invention.
Figure 4B:
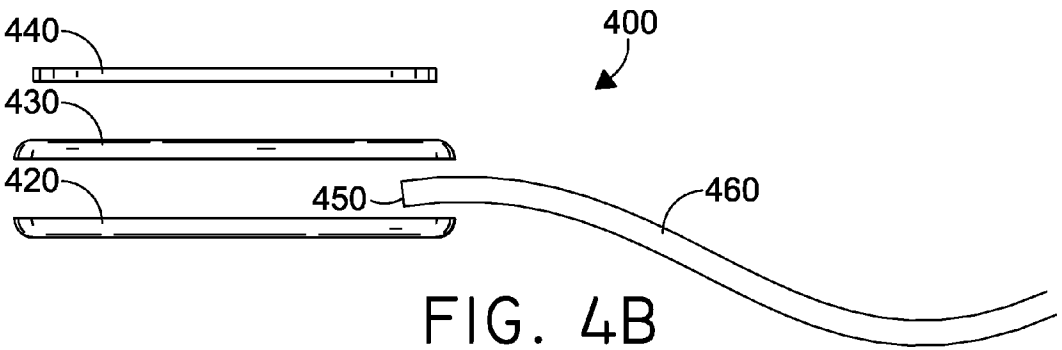
FIG. 4B depicts an expanded side view of an adjustment buckle embodying features of the present invention.

Turning now to FIG. 4A, a side view of an adjustment buckle illustrating features of the present invention is shown and designated generally as reference number 400. In FIG. 4B, an expanded side view of adjustment buckle 400 is shown. Adjustment buckle 400 may comprise several layers of materials such as an inner layer 420, middle layer 430 and outer layer 440. Inner layer 420 may comprise of a soft material that comes in contact with the wearer's skin when a swim top having adjustment buckle 400 is worn. Inner layer 420 may be constructed using a soft, flexible, non-abrasive material. By way of example, inner layer 420 may comprise of suede-like material that provides a soft touch on the skin of the wearer. Middle layer 430 may include reinforcement material that provides stability to the adjustment buckle 400. For example, middle layer 430 may comprise of a soft, rubber material. Middle layer 430 may also include a bonding material to facilitate laminating the inner and outer layers of the adjustment buckle 400. The bonding material may also be used to secure one end 450 of a cord 460 of the swim top between the layers of adjustment buckle 400 (FIG. 4B). In other examples of adjustment buckles, cord 460 may be stitched to middle layer 430. Outer layer 440 may include a soft, flexible, non-abrasive material similar to that of inner layer 420. Outer layer 440 may also include a non-slip material such as silicone that prevents slippage of the cords of a swim top that are threaded through the adjustment buckle 400.

Figure 5C:
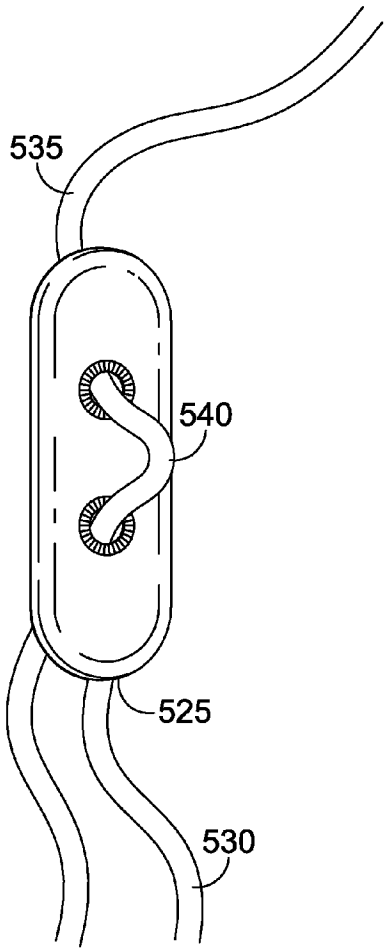
FIGS. 5A-5C depict the threading of a neck cord through an adjustment buckle embodying features of the present invention.
Figure 5B:
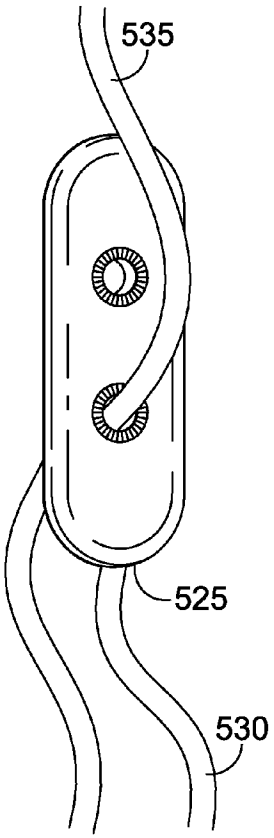
Figure 5A:
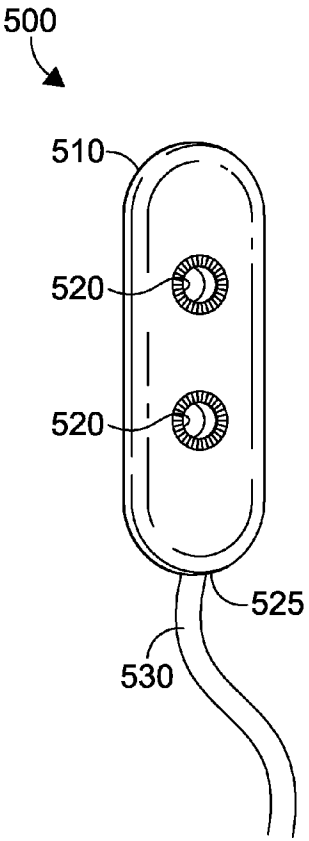

Referring now to FIG. 5A-5C, the threading of a neck cord through an adjustment buckle illustrating features of the present invention is shown and designated generally as reference number 500. In FIG. 5A an adjustment buckle 510 is depicted. Adjustment buckle 510 includes two holes 520 and a cord 530. As discussed with reference to FIG. 4B the terminal end 525 of cord 530 may be fixed between the layers of adjustment buckle 510. The unsecured end of cord 530 may extend around the neck of the wearer when a swim top in accordance with the present invention is worn. FIG. 5B illustrates the threading of a cord 535 through a hole 520 of adjustment buckle. Both cords 530 and 535 may be used in conjunction with the adjustment buckle 510 to adjustably secure the swim top to the wearer. As shown in FIG. 5C, cord 535 may then be passed through the second hole 520 of the adjustment buckle to form a loop 540. The unsecured end of cords 530 and 535 may extend, in conjunction, around the neck of the wearer when a swim top in accordance with the present invention is worn. A sliding halter swim top having adjustment buckle 510 may be adjusted by pulling loop 540 and sliding buckle 510 to the desired position.

Figure 6:
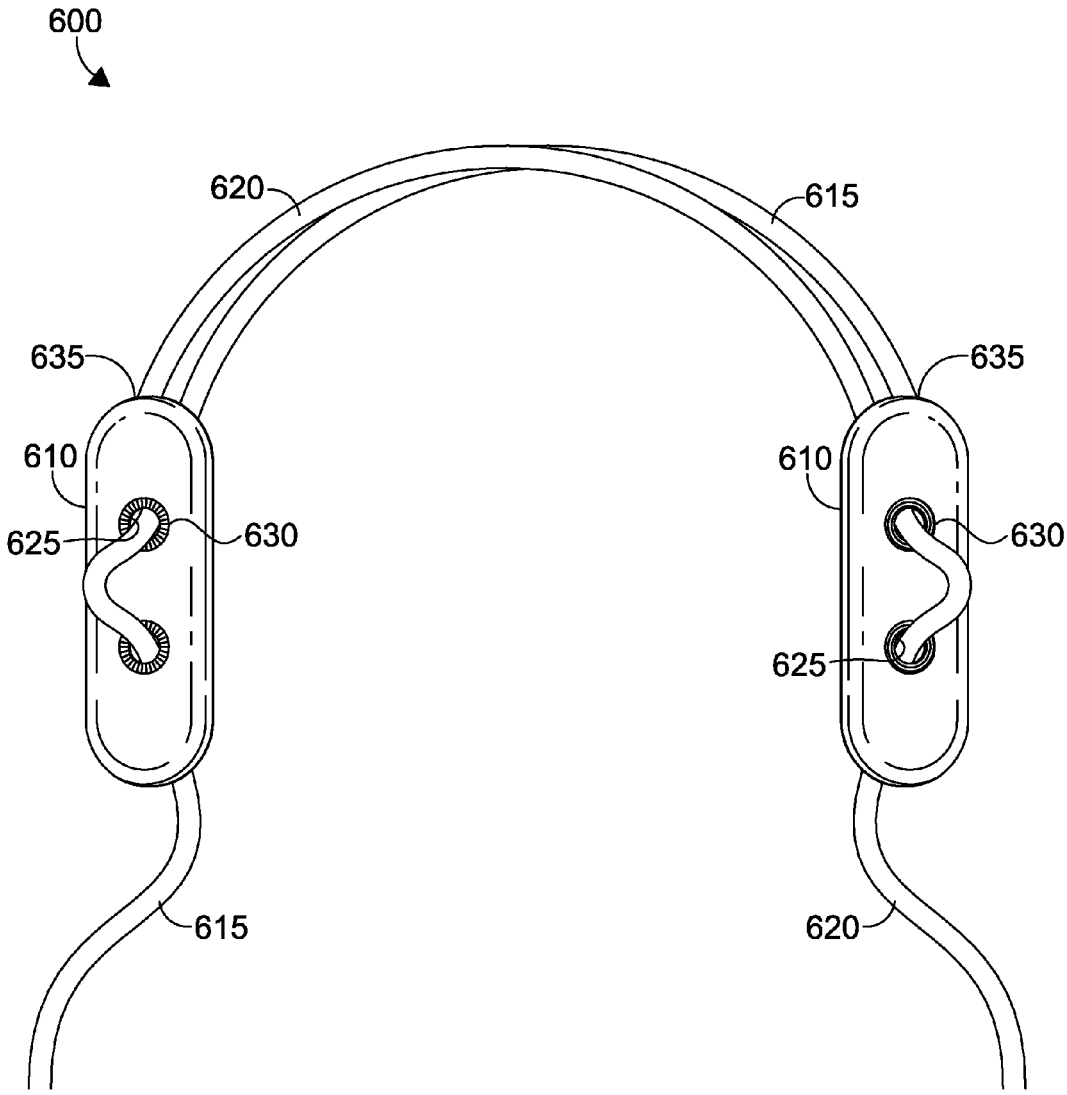
FIG. 6 depicts a front view of the assembled neck cord of a swim top embodying features of the present invention.

Turning now to FIG. 6, a front view of the assembled neck cord of a swim top illustrating features of the present invention is shown and designated generally as reference number 600. Neck cord assembly 600 may be utilized in a sliding halter swim top such as swim top 100. Assembly 600 may include two adjustment buckles 610 each buckle having two openings 625 through which either cord 615 or cord 620 is threaded. One end of each cord 615 and 620 may be secured between the layers of an adjustment buckle 610 at points 635. In addition, the other end each cord 615 and 620 may be threaded through the other adjustment buckle to form a halter that is secured around the neck of the wearer. The openings 625 in each adjustment buckle 610 may permit cords 615 and 620 to be slidably threaded through the openings 625 such that the buckles 610 may be comfortably flat against the skin of the wearer. A friction enhancing pattern 630 may be proximate to the openings 625 of the adjustment buckles 610. The friction enhancing pattern 630 may engage the cords 615 and 620 passing through openings 625 when the bikini top is worn to enhance the secure fit of the bikini top.

Figure 7:
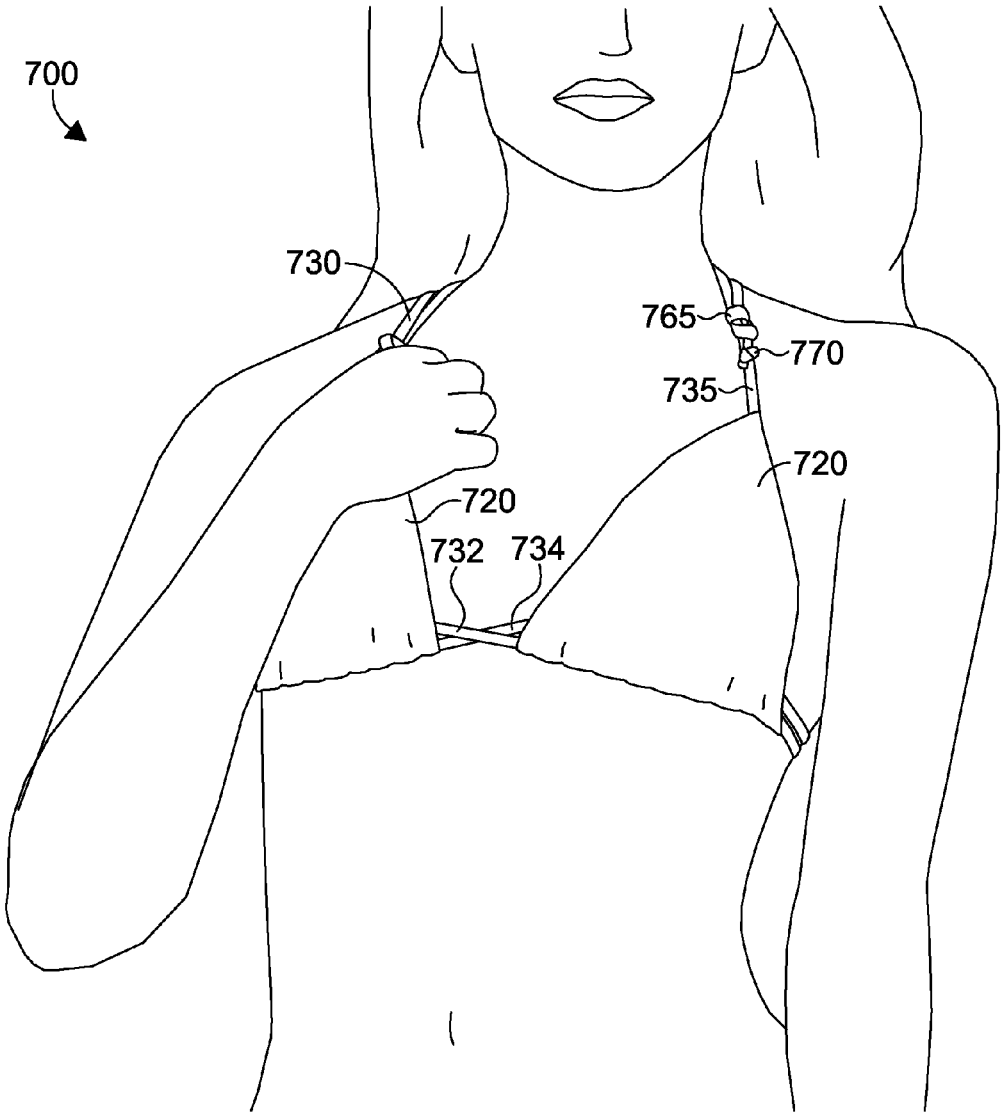
FIG. 7 depicts a swim top embodying features of the present invention being worn.

Turning now to FIG. 7, a swim top illustrating features of the present invention being worn is shown and designated generally as reference number 700. Swim top 700 may include panels 720, cords 732 and 734, cords 730 and 735, slidable knots 765 and fixed knots 770. The bikini top 700 may include two panels 720 configured to at least partially cover a wearer's breast when the bikini top 700 is worn. The two panels may include gathered hems along their bottom edges. The bikini top 700 may also include a pair of cords 732 and 732 connecting the two panels 720 by extending through the hems of the panels 720. Cords may secure the two panels to the torso of a wearer when the bikini top is worn. The pair of cords 732 and 734 may provide better security to the wearer during sporting activities. Bikini top 700 may also include a second pair of cords 730 and 735. Each of cords 730 and 735 may be attach to the top of one of the two panels 720. Cords 730 and 735 may be stitched to the tops of panels 720. In other instances, cords 730 and 735 may be threaded through the hems of panels 720. As illustrated in FIG. 7, cords 730 and 735 may extend behind a neck of the wearer when the bikini top 700 is worn. The bikini top 700 may also include a pair of friction locking adjustment terminal ends in the form of slidable knots 765. Slidable knots 765 may be securely affixed to an end of cords 730 or 735 and may be slidably affixed to the other of the cords 730 and 735. Slidable knots 765 may be secured using both cords 730 and 735 such that each knot 765 may be moved along either cord 730 and 735 by pulling on the knot 765. A second pair of fixed knots 770 may be located at the end of slidable knots 765 to prevent the slidable knots 765 from loosening. Each fixed knot 770 may be formed using the terminal end of either cord 730 or 735.

Figure 8A:
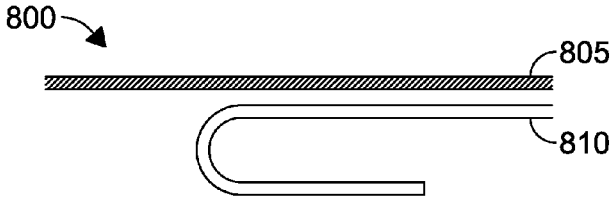
FIGS. 8A-8E depict the tying of a neck cord to form a slidabe knot terminal end embodying features of the present invention.
Figure 8B:
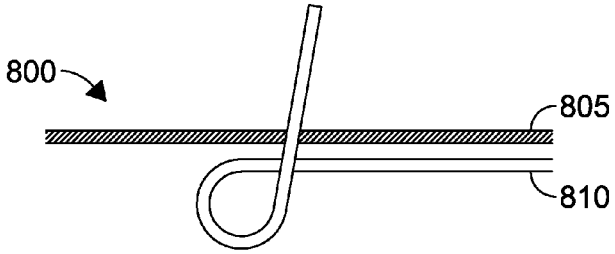
Figure 8C:
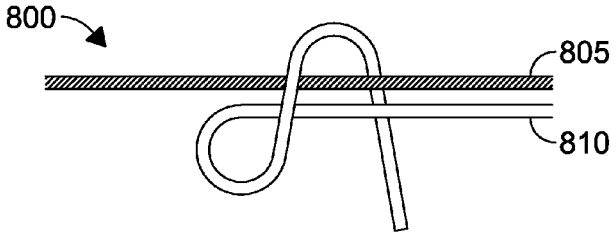
Figure 8D:
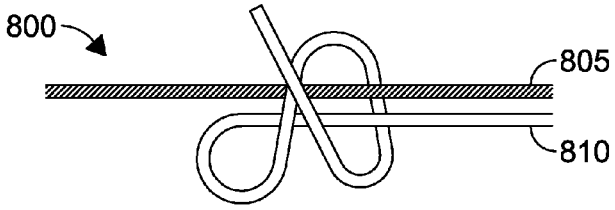
Figure 8E:
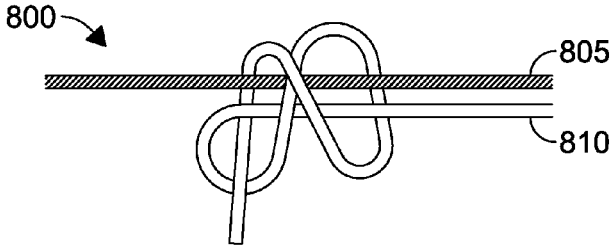

Turning now to FIGS. 8A-8E, the tying of a neck cord to form a slidabe knot terminal end illustrating features of the present invention is shown and designated generally as reference number 800. In FIG. 8A a pair of cords 805 and 810 are depicted. Cords 805 and 810 may be neck cords used to secure a bikini top, for instance bikini top 700 of FIG. 7, around the neck of wearer. As illustrated in FIG. 8A, cords 805 and 810 may be placed parallel to each other and one of the cords such as cord 810 may be folded to form a hair pin loop as shown in FIG. 8A. In FIG. 8B, the end of cord 810 may be folded to intersect cord 805 as depicted. As illustrated in FIG. 8C, the end of cord 810 may be folded under cord 805 such that one loop occurs below cord 805 and another loop occurs above cord 805. In FIG. 8D, the end of cord 810 may be folded upward to overlap cord 805 as depicted. As illustrated in FIG. 8E, the end of cord 810 may be inserted into the loop that occurs below cord 805 and pulled to form a slidable knot, for instance knot 765 of FIG. 7.

Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

Embodiments of the present invention provide swim tops having a friction locking cord adjustment system. The swim top in accordance with the present invention may have a pair of friction locking adjustment terminal ends, each secured to an end of one of a pair of neck cords of the swim top. The friction locking adjustment terminal ends may be slidably affixed to the other neck cord of the swim top. The friction locking adjustment terminal ends may be comprised of adjustment buckles or slidable knots. The adjustment buckles may also have two or more silicone pads having holes for threading the cords of the swim top. A friction enhancing pattern may be proximate to the holes of the adjustment buckles. The friction enhancing pattern may engage the cord passing through that hole when the bikini top is worn to enhance the secure fit of the bikini top.

The invention claimed is:

1. A bikini top comprising:

two panels configured to at least partially cover a wearer's breast when the bikini top is worn, wherein the two panels comprise hems along their edges;

a pair of cords connecting the two panels by extending through the hems of the panels, wherein the pair of cords secure the two panels to the torso of a wearer when the bikini top is worn;

a pair of adjustment buckles, wherein each of the pair of adjustment buckles is securely affixed to an end of one of the pair of cords and slidably affixed to the other of the pair of cords with each of the pair of adjustment buckles being situated above one of the two panels;

a pair of holes in each of the pair of adjustment buckles, wherein each adjustment buckle contains two holes such that the cords are threaded through the holes of each adjustment buckle; and a friction enhancing pattern near each hole in each of the pair of adjustment buckles, wherein the friction enhancing pattern engages the cord passing through that hole when the bikini top is worn.

2. The bikini top of claim 1, wherein the pair of holes in each of the pair of adjustment buckles permit the cord to be threaded through the adjustment buckle such that the buckle may be comfortably flat against the skin of the wearer.

3. The bikini top of claim 2, wherein the friction enhancing pattern is constructed from a silicone material printed on the adjustment buckle.

4. The bikini top of claim 3, wherein the friction enhancing pattern comprises at least one of, an eyelet-shaped, spiral shaped or concentric circle shaped pattern surrounding at least one of the openings of each of the pair of adjustment buckles.

5. The bikini top of claim 1, wherein each of the pair of adjustment buckles comprises one or more layers.

6. The bikini top of claim 5, wherein each of the pair of adjustment buckles is securely affixed to an end of one of the pair of cords by bonding the end of the cord between the one or more layers of the adjustment buckle.

7. A bikini top comprising:

two panels configured to at least partially cover a wearer's breast when the bikini top is worn, wherein the two panels comprise gathered hems along their bottom edges;

a first pair of cords connecting the two panels by extending through the gathered hems of the panels, wherein the first pair of cords secure the two panels to a torso of a wearer when the bikini top is worn;

a second pair of cords, each of the second pair of cords attaching to a top of one of the two panels and extending behind a neck of the wearer when the bikini top is worn; and a pair of slidable knots, each of the pair of slidable knots securely affixed to a terminal end of one of the second pair of cords and slidably affixed to the other of the second pair of cords.

* * * * *